US005529192A

United States Patent [19]

Conen et al.

[11] Patent Number: 5,529,192

[45] Date of Patent: Jun. 25, 1996

[54] DISPLAY FIXTURE SYSTEM

[76] Inventors: Ella B. Conen; Tzvi J. Broner, both of 30 Tangreen Circle, Thornhill, Ontario L4J 5E2, Canada

[21] Appl. No.: 221,415

[22] Filed: Mar. 31, 1994

[51] Int. Cl.[6] ..... A47F 5/00

[52] U.S. Cl. ..... 211/189; 52/672; 211/187

[58] Field of Search ..... 211/189, 59.2, 211/87, 88, 187; 52/36.4, 36.5, 36.6, 672, 670, 671, 673, 674, 675

[56] References Cited

U.S. PATENT DOCUMENTS

| | | | |
|---|---|---|---|
| 2,414,334 | 1/1947 | Schild . | |
| 3,044,632 | 7/1962 | Schild . | |
| 3,148,638 | 9/1964 | Schelor . | |
| 3,159,437 | 12/1964 | Jentzen | 211/187 X |
| 3,199,471 | 8/1965 | Orsi . | |
| 3,346,124 | 10/1967 | Sobel . | |
| 3,602,159 | 8/1971 | Marschak | 211/187 X |
| 3,610,562 | 10/1971 | Holmes et al. . | |
| 3,693,556 | 9/1972 | Rous . | |
| 3,844,231 | 10/1974 | Peacock . | |
| 3,931,894 | 1/1976 | Murphy | 211/189 |
| 3,971,477 | 7/1976 | Bruderly et al. | 211/189 |
| 4,108,085 | 8/1978 | Shepherd et al. | 211/187 X |
| 4,186,666 | 2/1980 | Honickman | 52/36.6 X |
| 4,324,076 | 4/1982 | Honickman . | |
| 4,378,925 | 4/1983 | Griffin . | |
| 4,450,970 | 5/1984 | Shepherd . | |
| 4,508,231 | 4/1985 | Honickman | 211/87 X |
| 4,705,175 | 11/1987 | Howard et al. | 211/59.2 |
| 4,716,841 | 1/1988 | Suttles . | |
| 5,185,971 | 2/1993 | Johnson, Jr. . | |
| 5,197,610 | 3/1993 | Bustos | 211/59.2 |
| 5,255,803 | 10/1993 | Pavone et al. | 211/189 |
| 5,313,891 | 5/1994 | Suttles . | |

FOREIGN PATENT DOCUMENTS

| | | |
|---|---|---|
| 811554 | 4/1969 | Canada . |
| 1178558 | 11/1984 | Canada . |
| 2623384 | 5/1989 | France . |
| 3308869C2 | 4/1984 | Germany . |
| 3639668A1 | 6/1987 | Germany . |
| 2242616 | 10/1991 | United Kingdom . |

*Primary Examiner*—Karen J. Chotkowski

*Attorney, Agent, or Firm*—Fay, Sharpe, Beall, Fagan, Minnich & McKee

[57] ABSTRACT

A display fixture system for holding and displaying merchandise for sale comprises:

a) a first substantially flat display panel having a front face, two side edges, a top end and a bottom end;

b) a pair of side walls integral with the first panel side edges and extending from the top end to the bottom end of the first display panel and each of the side walls extending perpendicularly and rearwardly of the first display panel from a respective side edge;

c) a pair of strengthening strips provided in the first panel and which are proximate respective side walls, each of the strengthening strips projecting outwardly of the panel front face and being integral therewith. The strengthening strips each extending from the top to the bottom end of the display panel;

d) devices for removably attaching to the first display panel front face a merchandise shelf hook or the like for holding and displaying the merchandise; and e) a device for holding the display panel system in an substantially upright position.

The display panel provides a load bearing structural unit of exceptional strength yet readily manufactured and readily installed to provide a variety of display designs.

25 Claims, 7 Drawing Sheets

DISPLAY FIXTURE SYSTEM

FIELD OF THE INVENTION

The present invention relates to a display fixture system, and more particularly to a fixture system for holding and displaying merchandise for sale, whereby substantially all of the weight of the merchandise is transferred vertically downwards.

BACKGROUND OF THE INVENTION

Display fixture systems are common in the retail industry for displaying merchandise offered for sale. Preferably, the merchandise is either displayed on shelves or it is hung on hooks. Shelves are typically arranged along a wall by securing at least two strips vertically to the wall. The strips have a plurality of small slots along their lengths in which brackets can be releasably attached. The shelves are then placed on the brackets. One of the main disadvantages of this strip and bracket system is that the strips must be very securely attached to the wall, especially if the merchandise to be displayed is relatively heavy. As such, a large number of attachment means, such as screws, are needed to keep the strips upright against the wall. This also results in the strip and bracket system not being flexible and versatile if the location of the shelves is to be changed.

Another display system available in the prior art is referred to as the "slot wall". This is a wood panel in which long horizontally disposed slots are provided. The slots are L-shaped in cross-section, thereby a portion of the wood panel forms a flange. Hooks or brackets are inserted and retained into the slots, and the merchandise is displayed thereon. A drawback of the slot wall is that the panel is generally constructed of particle board, thus the structural strength of the panel is weak. Accordingly, only relatively light weight merchandise, such as socks and clothing for example, can be held and displayed by the slot wall.

Accordingly, there is a need for a display fixture system that is versatile and capable of holding and displaying relatively heavy merchandise. By versatility, it is meant that the display fixture system can be easily mounted and dismounted, it can be easily placed in any location in a retail store, and it is modular so that it can be connected to other such systems to build a larger display fixture.

SUMMARY OF THE INVENTION

In one aspect of the present invention, a display fixture system is provided for holding and displaying merchandise for sale, comprising:

i) a first substantially flat display panel having a front face, two side edges, a top end and a bottom end;

ii) a pair of side walls extending from the top end to the bottom end of the first display panel, and each of the side walls extending perpendicularly and rearwardly of the first display panel from a respective side edge;

iii) at least one means for removably attaching to the first display panel front face a merchandise shelf, hook or the like for holding and displaying the merchandise; and iv) means for holding the display panel system in a substantially upright position, wherein the first display panel and the pair of side walls are integral with each other and are made from sheet metal, and wherein the held and displayed merchandise has a weight that is substantially all transferred vertically downwards through the display fixture system such that the holding means are relatively small in size, number and strength.

BRIEF DESCRIPTION OF THE DRAWINGS

The embodiments of the present invention will now be described with respect to the accompanying drawings, in which like numerals denote like parts in the several views, and in which.

DETAILED DESCRIPTION OF THE PREFERRED EMBODIMENT

Figure 1A:
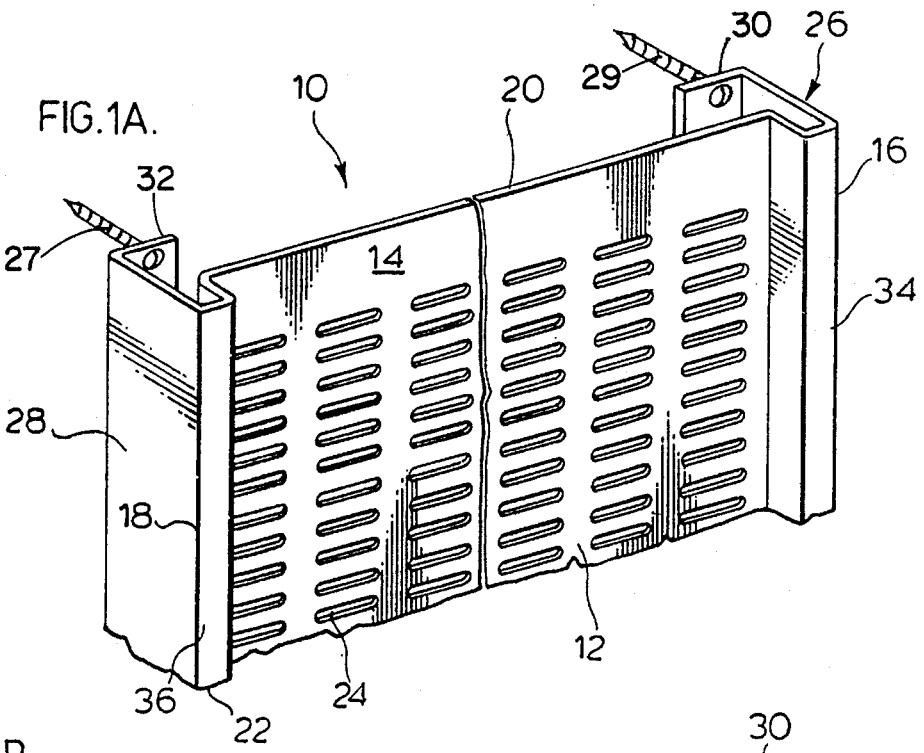
FIG. 1A is a partial perspective view of the display fixture system.
Figure 1B:
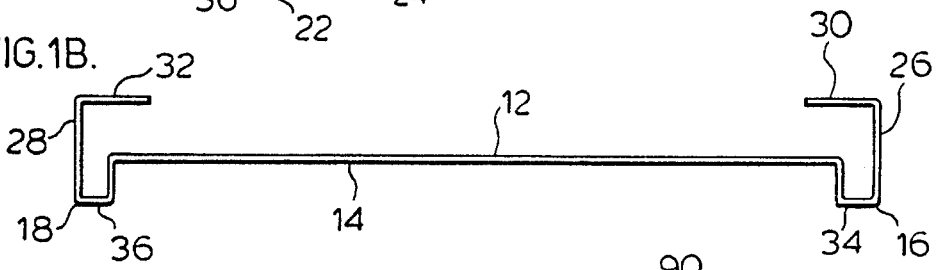
FIG. 1B is a cross-sectional view of the display fixture system of FIG. 1A.

Referring to FIGS. 1A and 1B, there is shown a first embodiment, generally denoted by the numeral 10, of the display fixture system of the present invention. The display fixture 10 includes a substantially flat display panel 12 having a front face 14, side edges 16 and 18, a top end 20 and a bottom end 22 (not shown). The display panel 12 has at least one means, and preferably a plurality of means, for removably attaching to the display panel 12 a merchandise shelf, hook or the like for holding and displaying merchandise for sale. In the embodiment of FIG. 1A, the attaching means are shown as a plurality of horizontally and/or vertically oriented, generally rectangular slots 24 into which a stud on the shelf, hook or the like is inserted.

Referring specifically to FIG. 1B, a cross-section of the display fixture system 10 of FIG. 1A is shown. The display fixture system 10 includes a pair of side walls 26 and 28, each extending perpendicularly and rearwardly of the front plane of the display panel 12. The side walls 26 and 28 extend from the top end 20 to the bottom end 22 of the front plane of the display panel 12. In the embodiment of FIG. 1B, the side walls 26 and 28 each further includes an additional flange 30 and 32, respectively. The flanges 30 and 32 are not necessary but are useful to assist in maintaining the stability of the display fixture system 10.

One feature of the display fixture system of the present invention is that the display panel 12 and the side walls 26 and 28 are integral with each other and constructed from one single piece of sheet metal. The sheet metal is bent at various locations to provide the general shape shown in FIG. 1A.

An important feature of the display fixture system of the present invention is that the weight of the merchandise held and displayed on the system is substantially all transferred vertically downwards. That is, the display system, even with merchandise displayed on it, has a small horizontal weight component relative to the vertical weight component, thereby allowing the display system to be easily held upright. It has been found by the inventors that one reason for this relatively large vertical weight component is that side walls 26 and 28 are at least 2 inches wide. This permits the display system to be held against a wall with relatively small holding means, such as a pair of screws 27, 29. On the other hand, if the display system is to be free-standing, that is located away from a wall, the system can easily be fitted onto a base to hold the system in an upright position. The size, number and strength of the holding means is, therefore, relatively small compared to prior art systems and to the amount of weight that can be supported by the display panel system. Furthermore, the nature of the panels substantially enhances the structural strength of the integral panels.

Referring again to FIGS. 1A and 1B, in a preferred embodiment of the present invention, the display panel 12 includes a pair of narrow side strips or shoulders 34 and 36 disposed proximate side edges 16 and 18, respectively. The side strips 34 and 36 are formed by bending the sheet metal perpendicularly and outwardly of front face 14, and then bending perpendicularly again to form the U-shaped side strips. These strips or shoulders which are in the shape of a channel opening rearwardly of face 14, provide additional strength in the overall structure particularly the longitudinal increased bending strength.

In the embodiment of FIGS. 1A and 1B, the side walls 26 and 28 are about 2½ inches wide, although it will be understood that any width greater than about 2 inches will be useful for purposes of attachment and strength. The distance between side edges 16 and 18 of display system 10 can vary, but preferably will be between about 12 and 36 inches. The width of the side strips 34 and 36 may also vary, but preferably is about ⅝ inches to about ¾ inches. The side strips 34 and 36 in the form of reinforcing channels extend the complete length of the panel. The vertical weight component of supported merchandise is transferred down the length the panel to the floor on which the panel is supported or resting by virtue of the longitudinally extending channels 34 and 36.

Figure 2:
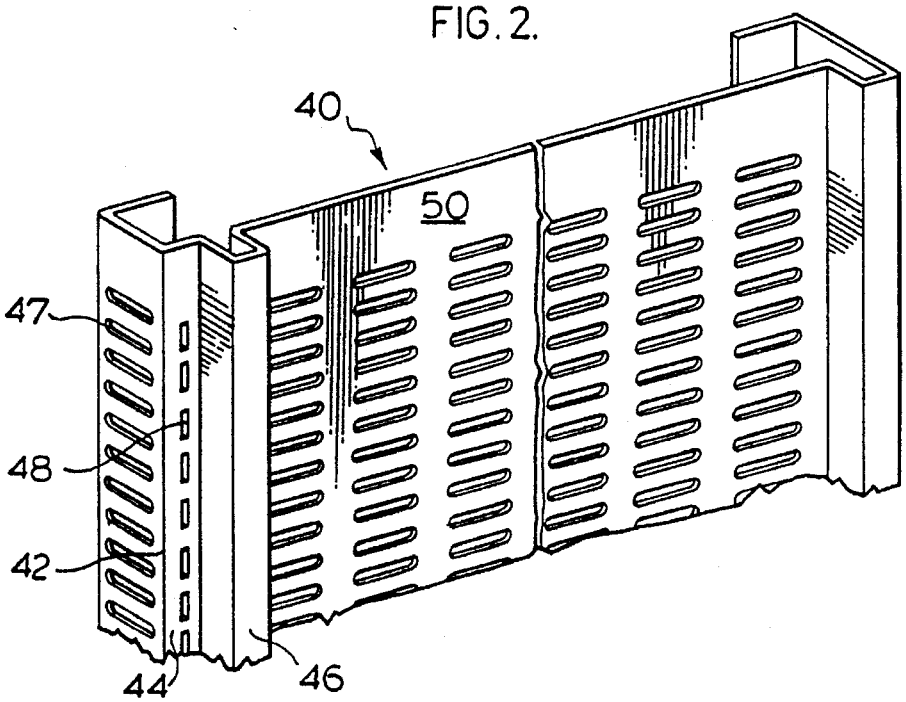
FIG. 2 which appears with FIG. 7 is a partial perspective view of a further embodiment of the display fixture system of the present invention.

With reference to FIG. 2, a second embodiment of the display fixture system is illustrated, generally denoted by numeral 40. Display system 40 is similar to display system 10 of FIGS. 1A and 1B, except that adjacent side edge 42 has a holding strip 44. Side strip 46 is located adjacent holding strip 44, rather than adjacent side edge 42 as was the case with the display fixture system 10 of FIGS. 1A and 1B. Holding strip 44 includes at least one means, and preferably a plurality of means for removably attaching to the holding strip 44 a merchandise shelf, hook or the like. The attaching means 48 shown in FIG. 2A are vertically oriented rectangular slots. In the embodiment of FIG. 2, the width of holding strip 44 can vary, and preferably is about ⅝ inches wide, and as shown in FIG. 2, its face is on the same plane as front face 50. Optionally horizontal, slots 47 may be provided in the side.

Figure 3C:
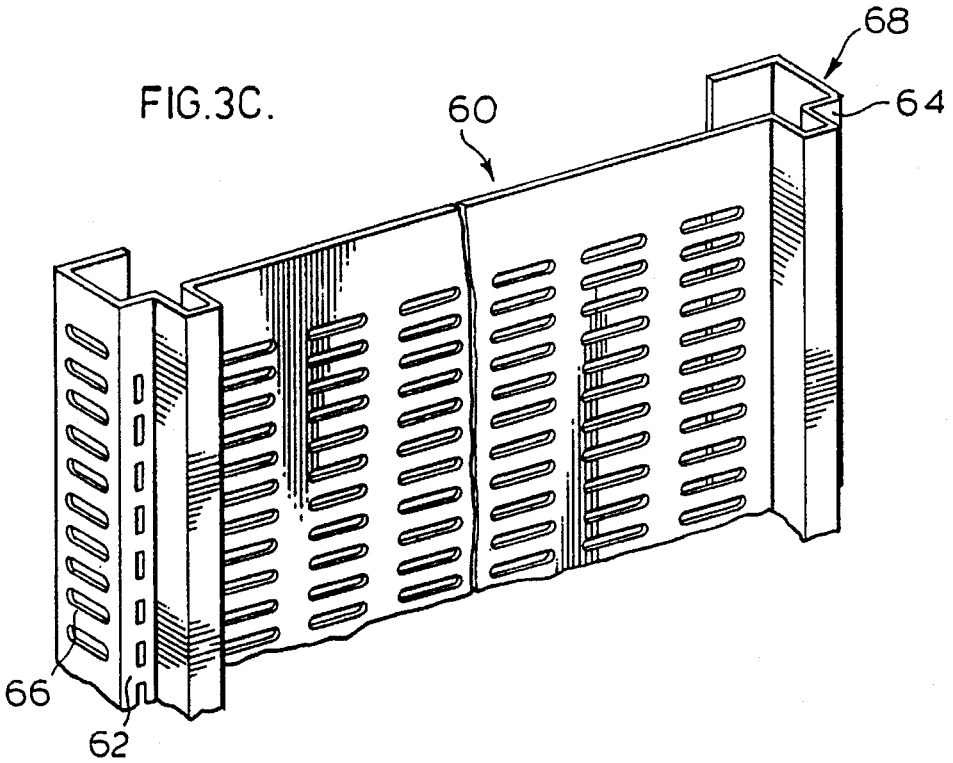
FIG. 3C is a partial perspective view of the display fixture system of FIG. 3A.
Figure 3B:
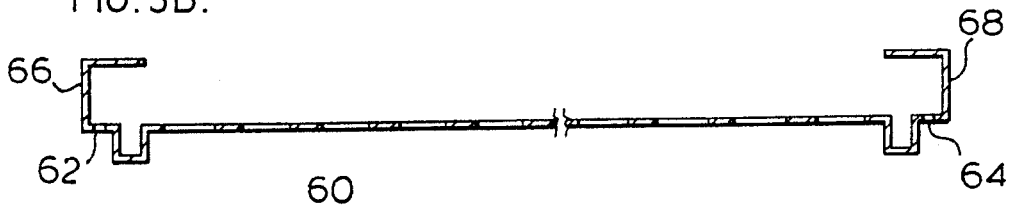
FIG. 3B is a cross-sectional view of the display fixture system of FIG. 3A.
Figure 3A:
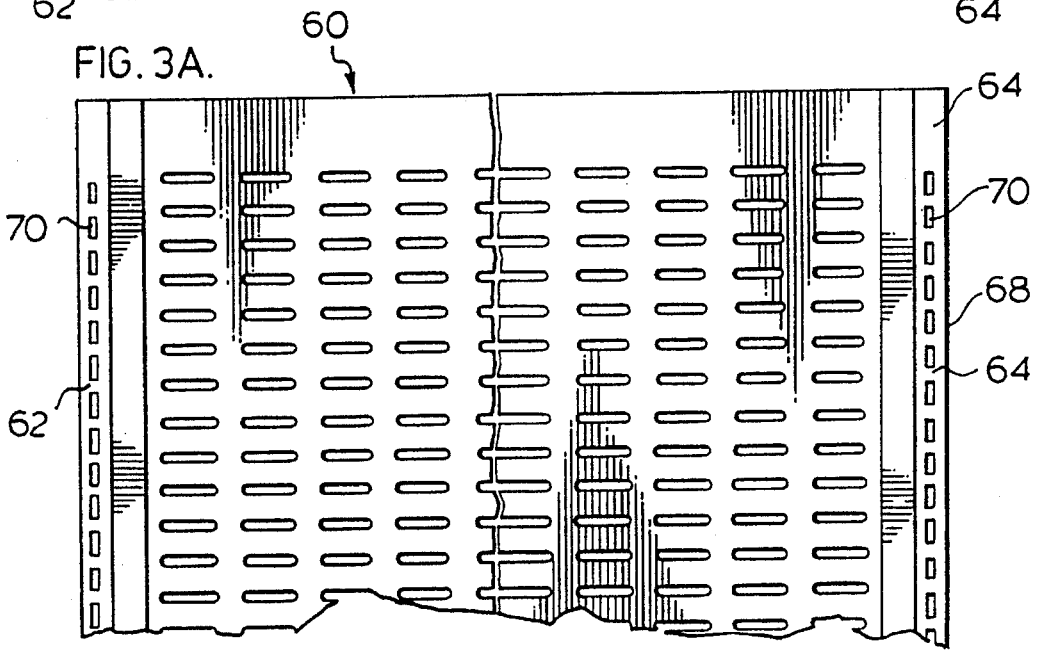
FIG. 3A is a partial front elevation view of a further embodiment of the display fixture system of the present invention.

In the embodiment of FIGS. 3A, 3B and 3C, display fixture system 60 includes two holding strips 62 and 64 adjacent side edges 66 and 68, respectively. Each of holding strips 62 and 64 include at least one means, and preferably a plurality of means for removably attaching to the holding strips 62 and 64 a merchandise shelf, hook or the like. The attaching means 70 shown in FIGS. 3A and 3C are vertically oriented rectangular slots.

Figure 4:
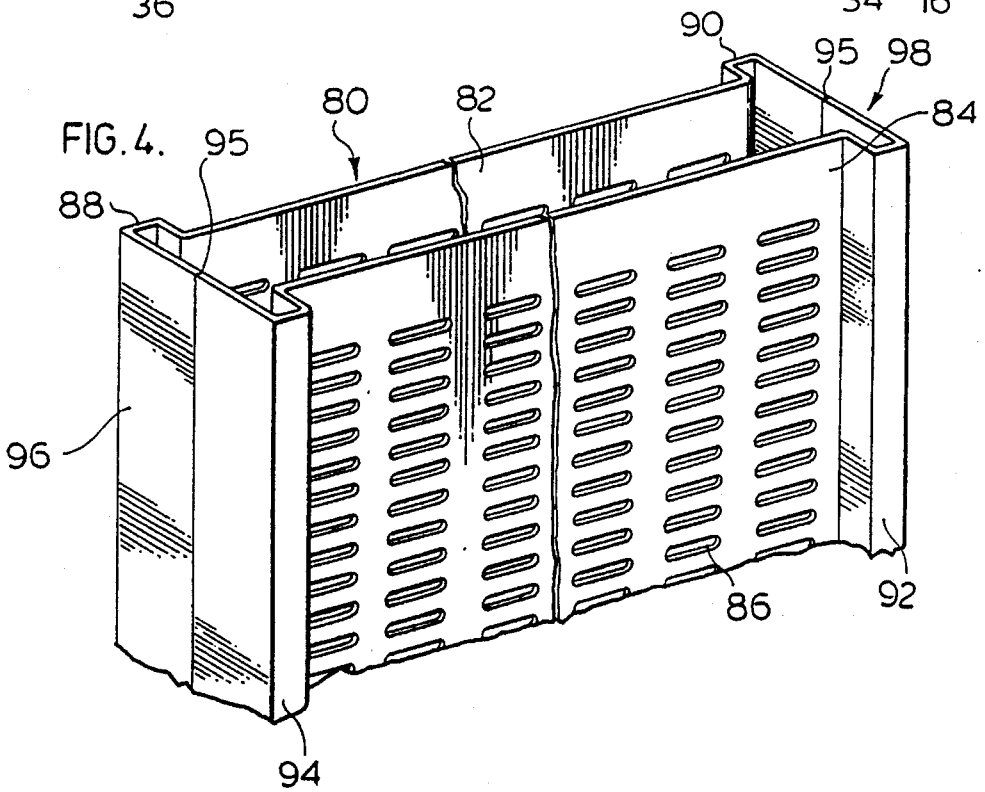
FIG. 4 which appears with FIG. 1A is a partial perspective view of a further embodiment of the display fixture system of the present invention.

In FIG. 4, a further embodiment of the fixture system of the present invention is shown. In this embodiment, denoted by the numeral 80, a second substantially flat display panel 82 is provided in addition to the first display panel 84. The second display panel 82 is identical to the first display panel 84, thereby allowing merchandise to be held and displayed on both sides of the system 80. FIG. 4 shows in detail the first display panel 84. Second display panel 82 is similar to display panel 84 so that it also includes at least one means, and preferably a plurality of means for removably attaching a merchandise shelf, hook or the like. In system 80, the preferred attaching means 86 are horizontally oriented generally rectangular slots. The display panels may be joined at a welded seam or coupled at a seam by mechanical fasteners optionally with use of inverted reinforcement channels at the bottom and top of the joined panels.

The double-sided display system 80 of FIG. 4 also includes a pair of narrow side strips on each of the display panels 82 and 84 respectively. The side strips or shoulders 88, 90, 92 and 94 are located proximate the side edges of each display panel 82 and 84.

In the display fixture system 80, side walls 96 and 98 are, preferably, about 3 inches wide, ½ inches wider than the embodiments in FIGS. 1, 2 and 3. The additional width accommodates side strips 88 and 90 which are provided on the second display panel 82. Another difference between display system 80 and the earlier described embodiments is that display panel 82 need not be integral with display panel 84 and side walls 96 and 98. That is, display panel 82 may be constructed from a second piece of sheet metal and connected to a flange 95 on side walls 96 and 98 by means of welding. It will be understood that display fixture system 80 may be of any convenient width, preferably between 12 inches and 36 inches wide.

Figure 6:
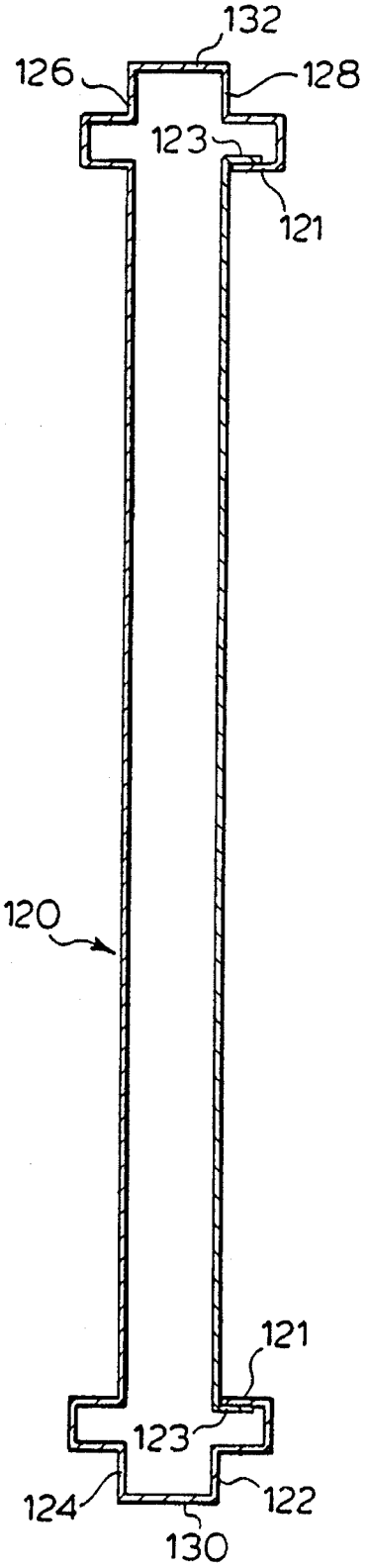
FIG. 6 is a cross-sectional view of a further embodiment of the display fixture system of the present invention.
Figure 5:
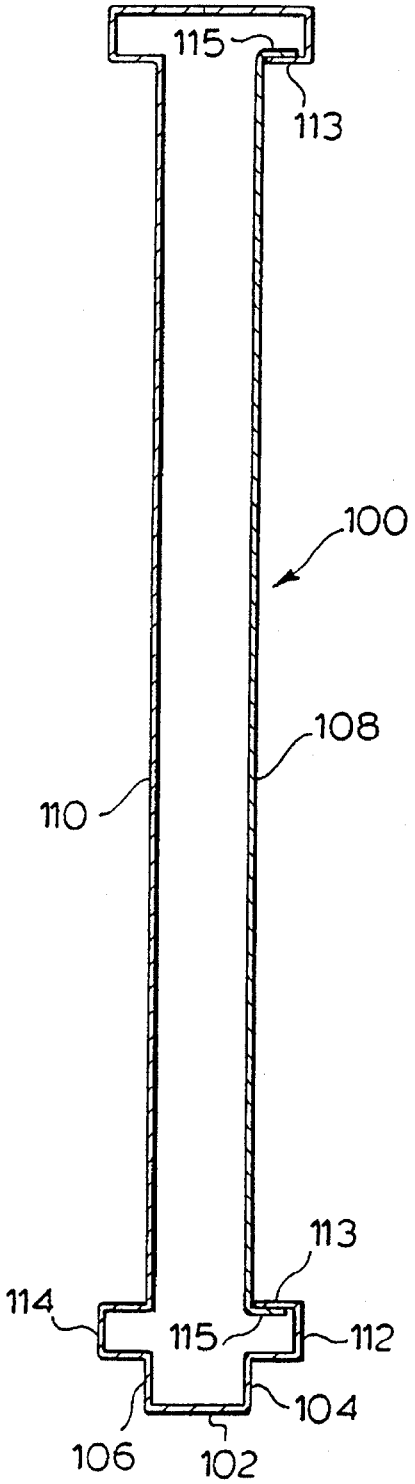
FIG. 5 is a cross-sectional view of a further embodiment of the display fixture system of the present invention.

In FIGS. 5 and 6, two further embodiments of the invention are shown. In both cases, double-sided display systems are shown. In FIG. 5, display system 100 is similar to display system 80 of FIG. 4, except that adjacent side edge 102 is disposed holding strips 104 and 106 on each of display panels 108 and 110. Side strip 112 is located adjacent holding strip 104, rather than adjacent side edge 102 as was the case with the display fixture system 80 of FIG. 4. Similarly, side strip 114 is located adjacent holding strip 106 rather than side edge 102. Each of holding strips 104 and 106 include at least one means, and preferably a plurality of means for removably attaching to the holding strips 104 and 106 a merchandise shelf, hook or the like (the attaching means not being shown in FIG. 5). The attaching means are vertically oriented rectangular slots similar to those shown in FIGS. 3A and 3C. In the embodiment of FIG. 5, the holding strips 104 and 106 are ⅝ inches wide, and their faces are on the same plane as the respective faces of display panels 108 and 110.

In the embodiment of FIG. 6, display fixture system 120 includes holding strips 122, 124, 126 and 128 adjacent side edges 130 and 132, respectively. Each of the holding strips include at least one means, and preferably a plurality of means for removably attaching to the holding strips a merchandise shelf, hook or the like (not shown in FIG. 6). The attaching means are vertically oriented rectangular slots similar to those shown in FIG. 3A and 3C.

In the particular embodiments of FIGS. 5 and 6, the spaced apart display panels are welded together at overlapping flange portions. In FIG. 5, flanges 113 and 115 are welded together at both ends to provide an integral unit. Similarly, flanges 121 and 123 at each end of the structure of FIG. 6 are welded together to provide an integral unit.

Although not specifically shown, it will be understood that one or more of the side walls in display systems 80, 100 and 120 of FIGS. 4 to 6 may also include at least one means, and preferably a plurality of means for removably attaching a merchandise shelf, hook or the like thereto. As such, systems 80, 100 and 120 become more versatile in that merchandise may be displayed on the side walls in addition to the display panels.

Figure 7:
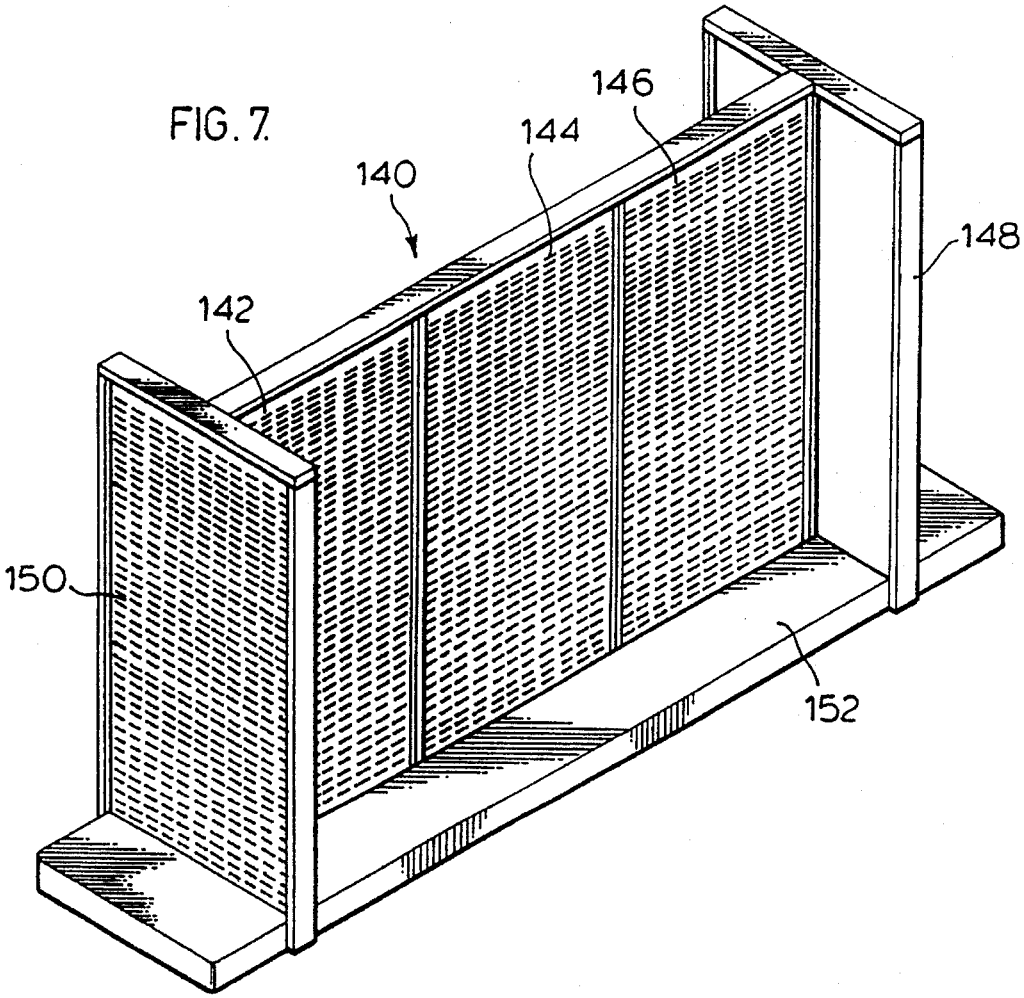
FIG. 7 is a perspective view of one example of a display case formed by interconnecting a plurality of display fixture systems of the present invention.

The display fixture system of the present invention is modular in the sense that two or more such systems may be combined and interconnected to create a display case of various sizes and shapes. For example, FIG. 7 illustrates a display case 140 in which three double-sided systems 142, 144 and 146 are connected side by side. Two display systems 148 and 150 are connected perpendicularly at the ends, and all are held on base 152. The result is a free-standing display case capable of holding and displaying merchandise in all four directions. The base is of sufficient platform area and weight to preclude accidental knocking over of the display.

Figure 8:
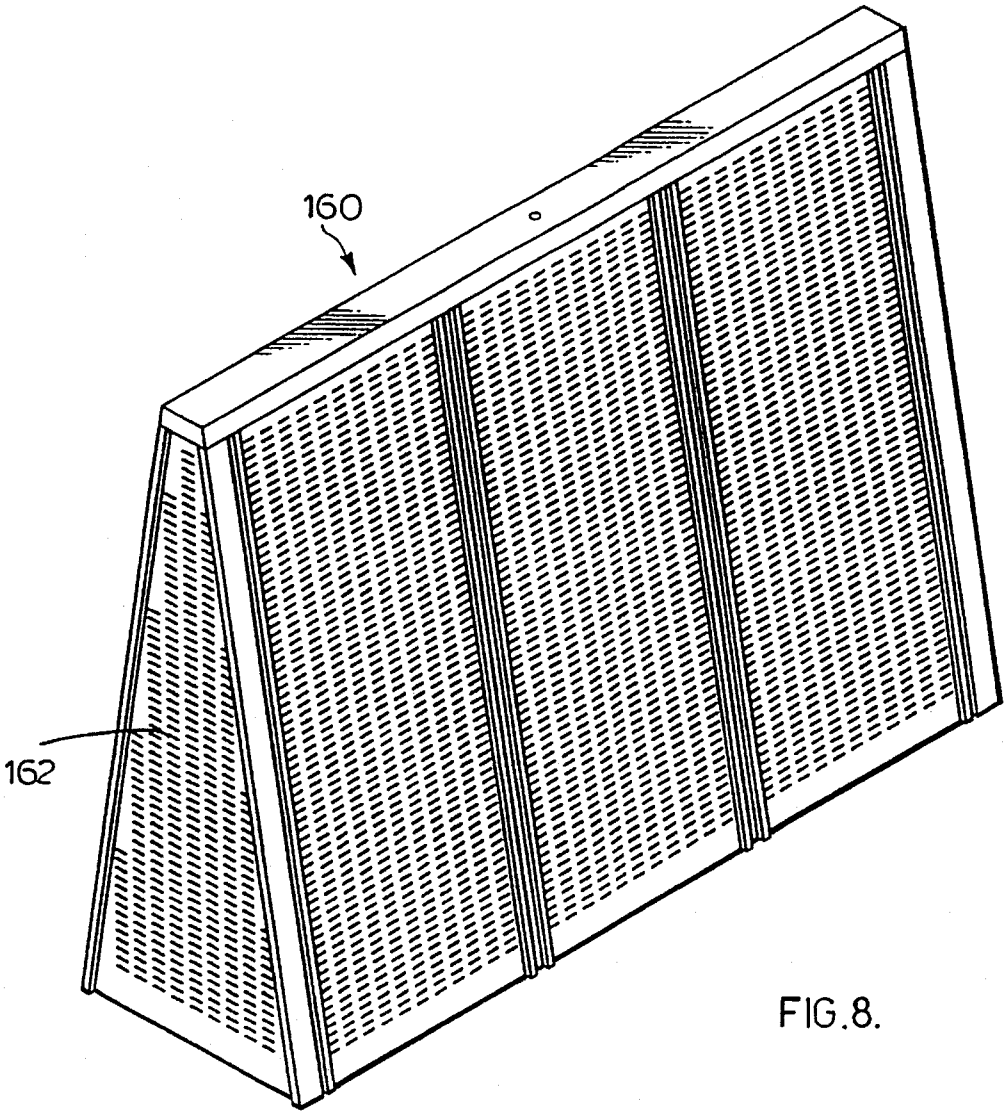
FIG. 8 is a perspective view of another example of a display case formed by interconnecting a plurality of display fixture systems of the present invention.
Figure 9:
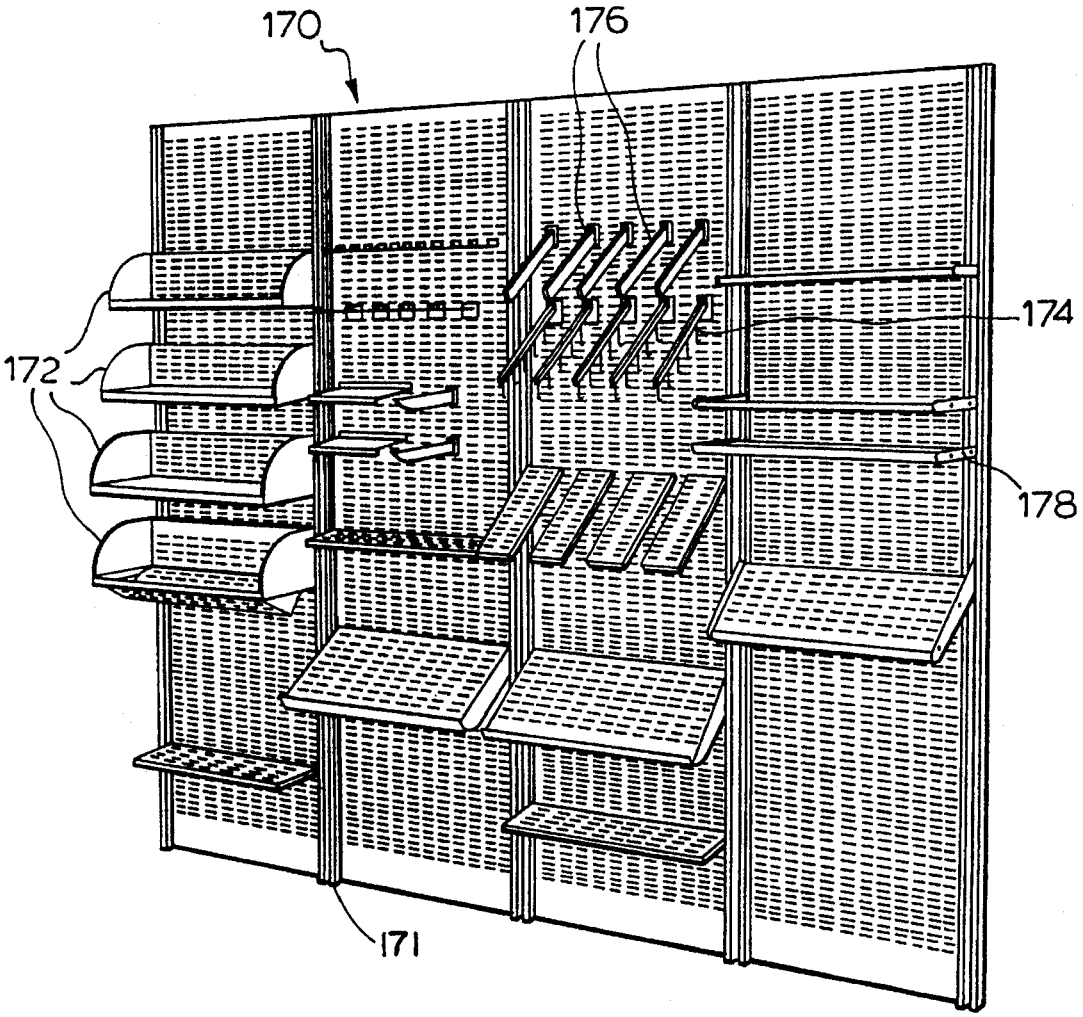
FIG. 9 is a perspective view of a plurality of display fixture systems of the present invention mounted for displaying merchandise along a wall.

Another example of a modular display case is shown in FIG. 8. In that example, the case 160 does not require a base. Rather, the end panels 162 are generally triangular in shape, allowing the case to be self-supporting. FIG. 9 illustrates a wall-mounted display case 170 where the bottom edge of the panels rest on the floor so that any vertical component of display weight supported by said channel is transferred to the floor by the channel resting directly on the floor at 171. A plurality of display panels are connected side by side to a wall. FIG. 9 also shows some examples of the various types of merchandise shelves, hooks, etc. that can be used, such as metal shelves 172, hooks 174, bars 176 and hang bars 178. It will be understood that different types of merchandise-holding means may be used, and these can preferably be removedly attached to the display panels so as to make the systems more versatile.

Figure 10:
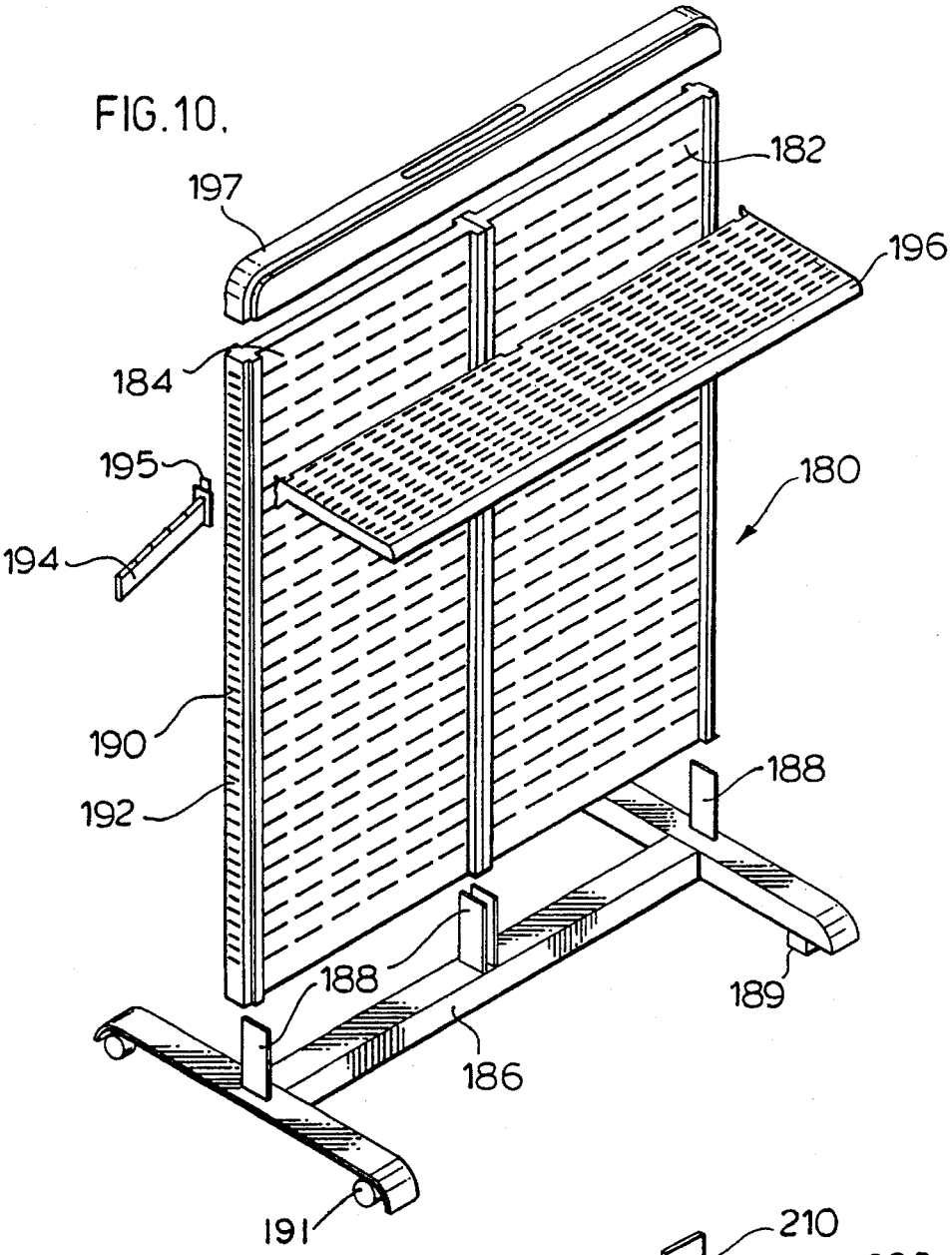
FIG. 10 is an exploded perspective view of a freestanding display case constructed with the display fixture systems of the present invention.

FIG. 10 illustrates another example of a display case 180 made with two fixture systems 182 and 184 of the present invention. Case 180 is free-standing and supported on a base 186 on which the systems 182 and 184 are held. Base 186 includes a plurality of retaining arms 188 which are adapted to be inserted into the systems 182 and 184, thereby retaining them. The support channels 191 as they interact with arms 188 rest directly on the base 186 thereby transferring to the base any vertical component of display weight. The base 186 may be provided with casters 187 or have solid feet as at 189. Display case 180 further includes attaching means 190 on side wall 192. A merchandise hook 194 can be removably attached to side wall 192 for holding and displaying merchandise for sale. The hook 194 has at its inner end studs 195 which fit in slots 190 in the normal manner in order to secure the hook in outstanding position. A merchandise shelf 196 is also shown, which can be removably attached to the display systems 182 and 184. Finally, case 180 may optionally have a decorative header 197, which is adapted to be inserted on top of the systems 182 and 184 for making the case 180 attractive.

Figure 11:
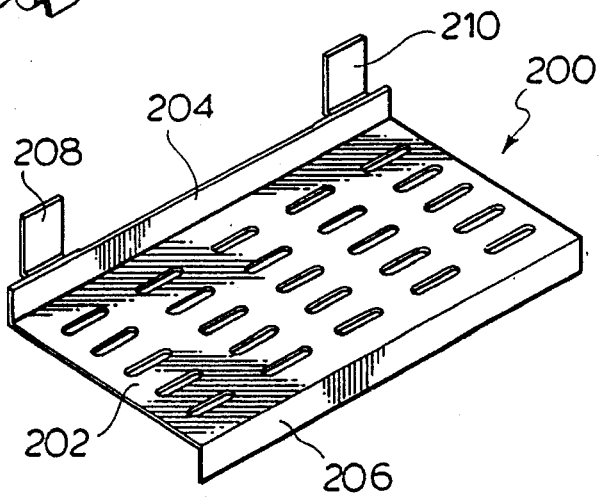
FIG. 11 is a perspective view of an example of a merchandise shelf that can used with the display fixture system of the present invention.

An example of a merchandise shelf 200 is shown in FIG. 11. Shelf 200 includes a display area 202, a rear flange 204 and a front flange 206. A pair of retaining studs or fingers 208 and 210 are provided proximate the ends of rear flange 204. Fingers 208 and 210 are adapted to cooperate with the attaching means on the fixture system of the present invention to attach the shelf 200 thereon. The fingers are inserted into corresponding rectangular slots in the system to hold the shelf thereon. It will be understood that similar fingers may be provided on hooks and other such merchandise holders.

Although preferred embodiments of the invention are described herein in detail, it will be understood by those skilled in the art that variations may be made thereto without departing from the spirit of the invention or the scope of the appended claims.

We claim:

1. A display fixture system comprising:

a) a first substantially flat display panel having a front face, two side edges, a top end and a bottom end;

b) a pair of side walls integral with said first panel side edges and extending from the top end to the bottom end of the first display panel, and each of the side walls extending perpendicularly and rearwardly of the first display panel from a respective side edge;

c) a pair of strengthening strips provided in said first panel and which are proximate respective said side walls, each of said strengthening strips projecting outwardly of said panel front face and being integral therewith, said strengthening strips each extending from the top to the bottom end of the first display panel;

d) at least one means for removably attaching to the first display panel front face a merchandise shelf, hook or the like for holding and displaying the merchandise; and e) means for holding the display panel system in a substantially upright position; wherein the first display panel and the pair of side walls are integral with each other and are made from sheet metal, and wherein the held and displayed merchandise has a weight that is substantially all transferred vertically downwards through the display fixture system such that the holding means are relatively small in size, number and strength.

2. The display fixture system of claim 1, wherein the holding means comprises a pair of screws for attaching the display fixture system to a wall.

3. The display fixture system of claim 1, wherein the holding means comprises a base on which the display fixture system is held.

4. The display fixture system of claim 1, wherein at least one of the side walls includes at least one means for removably attaching to the at least one side wall a merchandise shelf, hook or the like for holding and displaying the merchandise.

5. The display fixture system of claim 1, wherein the display panel further comprises a holding strip adjacent at least one of the side edges, each holding strip having at least one means for removably attaching to the holding strip a merchandise shelf, hook or the like for holding and displaying the merchandise.

6. The display fixture system of claim 1, further comprising means for removably attaching the display fixture system to a second display fixture system to form a modular display case.

7. The display fixture system of claim 1, wherein the removably attaching means comprises a generally rectangular slot through which a holding finger on the merchandise shelf, hook or the like can be inserted.

8. The display fixture system of claim 1, further comprising:

f) each of the said side walls having a side rear edge extending from top to bottom end of said panel and integral section of said sheet having a strengthening strip formed therein which is opposite a respective said strengthening strip in said first panel;

g) each of said strengthening strips providing a flange to which a second flat display panel is connected; and h) at least one means for removably attaching on said second display panel front face a merchandise shelf, hook or the lie for holding and displaying the merchandise.

9. The display fixture system of claim 1, wherein said strengthening strip is a reinforcing channel.

10. The display fixture system of claim 9, wherein said channel is U-shaped.

11. The display fixture system of claim 8, wherein said strengthening strip is a reinforcing channel.

12. The display fixture system of claim 11, wherein said channel is U-shaped.

13. A display fixture panel for use in a display fixture system, being an integral structural unit of sheet metal and said panel comprising:

a) a first substantially flat display panel having a front face, two side edges, a top end and a bottom end, b) a pair of side walls integral with said first panel side edges and extending from the top end to the bottom end of the first display panel and each of the side walls extending perpendicularly and rearwardly of the first display panel from a respectively said side edge;

c) a pair of strengthening strips provided in said first panel and which are proximate respective said side walls, each of said strengthening strips projecting outwardly of said panel front face and being integral therewith, said strengthening strips each extending from the top end to the bottom end of the first display panel; and d) at least one means for removably attaching to the first display panel front face a merchandise shelf, hook or the like for holding and displaying the merchandise.

14. The display fixture system of claim 8, wherein the display panels further comprise a holding strip adjacent at least one of the side edges, each holding strip having at least one means for removably attaching to the holding strip a merchandise shelf, hook or the like for holding and displaying the merchandise.

15. The display fixture system of claim 14, wherein each of the display panels comprise a pair of holding strips adjacent a respective one of the side edges, each of the holding strips having at least one means for removably attaching to the holding strip a merchandise shelf, hook or the like for holding and displaying the merchandise.

16. A display fixture panel of claim 13 wherein said strengthening strip is spaced inwardly of said side wall, a holding strip integral with and being positioned between said strengthening strip and said side wall, said holding strip having means for removably receiving a merchandise shelf, hook or the like for holding and displaying merchandise.

17. A display fixture panel of claim 13 wherein said panel is substantially flat.

18. The display fixture system of claim 13, wherein said strengthening strip is a reinforcing channel.

19. The display fixture system of claim 18, wherein said channel is U-shaped.

20. The display fixture panel of claim 13 further comprising:

e) each of the said side walls having a side rear edge extending from top to bottom end of said panel and integral section of said sheet having a strengthening strip formed therein which is opposite a respective said strengthening strip in said first panel;

f) each of said strengthening strips providing a flange to which a second flat display panel is connected; and g) at least one means for removably attaching on said second display panel front face a merchandise shelf, hook or the lie for holding and displaying the merchandise.

21. The display fixture panel of claim 20, wherein at least one of the side walls includes at least one means for removably attaching to the said at least one side wall a merchandise shelf, hook or the like for holding and displaying the merchandise.

22. The display fixture panel of claim 20, wherein the display panel further comprises at least one holding strip adjacent the strengthening strip of each side support, the at least one holding strip having at least one means for removably attaching to the holding strip a merchandise shelf, hook or the like for holding and displaying the merchandise.

23. The display fixture system of claim 13, wherein at least one of the side walls includes at least one means for removably attaching to the at least one side wall a merchandise shelf, hook or the like for holding and displaying the merchandise.

24. The display fixture system of claim 13, wherein the removably attaching means comprises a generally rectangular slot through which a holding finger on the merchandise shelf, hook or the like can be inserted.

25. The display fixture system of claim 20, wherein the removably attaching means comprises a generally rectangular slot through which a holding finger on the merchandise shelf, hook or the like can be inserted.

* * * * *